US005561348A

United States Patent [19]

Schoenbach et al.

[11] Patent Number: 5,561,348

[45] Date of Patent: Oct. 1, 1996

[54] FIELD CONTROLLED PLASMA DISCHARGE DEVICE

[75] Inventors: Karl H. Schoenbach, Norfolk, Va.; William C. Nunnally, Fort Worth, Tex.

[73] Assignee: Old Dominion University, Norfolk, Va.

[21] Appl. No.: 420,973

[22] Filed: Apr. 10, 1995

[51] Int. Cl.[6] ..... H05B 37/00

[52] U.S. Cl. ..... 315/169.1; 315/169.3; 315/169.4

[58] Field of Search ..... 315/169.1, 169.3, 315/169.4; 313/498, 500, 506, 509

[56] References Cited

U.S. PATENT DOCUMENTS

| | | | |
|---|---|---|---|
| 3,753,041 | 8/1973 | Lustig et al. | 315/169.1 |
| 3,875,442 | 4/1975 | Wasa et al. | 313/193 |
| 3,882,342 | 5/1975 | Kamegaya et al. | 313/188 |
| 3,952,221 | 4/1976 | Kamegaya et al. | 313/188 |
| 3,969,650 | 7/1976 | Chodil et al. | 315/169 TV |
| 3,992,644 | 11/1976 | Chodil et al. | 313/217 |
| 4,021,695 | 5/1977 | Kamegaya et al. | 313/188 |
| 4,029,984 | 6/1977 | Endiz | 313/96 |
| 4,130,777 | 12/1978 | De Jule | 315/169 TV |
| 4,227,114 | 10/1980 | De Jule | 313/217 |
| 4,229,766 | 10/1980 | Sipos | 358/209 |
| 4,322,659 | 3/1982 | De Jule et al. | 315/169.1 |
| 4,352,101 | 9/1982 | De Jule | 340/769 |
| 4,370,651 | 1/1983 | Reible, Jr. | 340/825.86 |
| 4,392,075 | 7/1983 | Kamegaya et al. | 313/584 |
| 4,422,014 | 12/1983 | Glaser | 315/169.4 |
| 4,472,659 | 9/1984 | Kamegaya et al. | 313/584 |
| 4,529,909 | 7/1985 | Kamegaya et al. | 313/584 |
| 5,430,458 | 7/1995 | Weber | 345/60 |

*Primary Examiner*—Robert Pascal
*Assistant Examiner*—David Vu
*Attorney, Agent, or Firm*—Jenkens & Gilchrist, P.C.

[57] ABSTRACT

A field controlled plasma discharge display element is disclosed for use in single element and multiple element plasma displays. The display element includes a pair of hollow discharge electric field electrodes, and a third electrode positioned external to and aligned with the discharge electric field electrodes for generating a control electric field proximate to the discharge electric field. The control electric field is used to control the intensity of the plasma discharge by distorting the shape of the generated discharge electric field. In a multiple element plasma display using a plurality of the individual display elements of the present invention arrayed in a matrix configuration, a control means is used to control activation and intensity of individual display elements. Individual ones of the elements in the matrix are addressed by a switching circuit including orthogonal control lines in order to instigate a plasma discharge.

53 Claims, 4 Drawing Sheets

FIELD CONTROLLED PLASMA DISCHARGE DEVICE

BACKGROUND OF THE INVENTION

1. Technical Field of the Invention

The present invention relates to plasma discharge devices.

2. Description of Related Art

A plasma discharge device in its most simple single element form includes at least an anode electrode and a cathode electrode spaced apart from each other to define a discharge cell. A low pressure atmosphere of a gas mixture, typically including an ionizable inert (noble) gas, is maintained between the electrodes. When a sufficient potential is applied between the anode and cathode electrodes, an avalanche breakdown of the insulating properties of the gas occurs and a current flows between the electrodes forming a plasma discharge. The plasma discharge in the discharge cell comprises energetic electrons, excited atoms and ions.

The collision of the energetic electrons in the plasma discharge with the gas atoms maintained in the discharge cell ionizes the gas atoms, with the ionized gas atoms emitting a wide spectrum of radiation in the form of photons of light. The characteristics of the ionizable inert gas or mixture of gases maintained in the discharge cell dictate the dominant wavelength of the photons of light radiated from the discharge cell. For example, neon gas atoms will emit visible red-orange photons of light when excited by a plasma discharge. Xenon gas atoms, on the other hand, will emit primarily invisible ultraviolet photons of light that are converted to visible light using UV-excitable phosphors.

The prior art further teaches the assembly of a plurality of individual discharge elements in a matrix configuration to form a panel plasma discharge display. In such multi-element plasma displays, a discharge cell is positioned at each of the points of intersection between orthogonally oriented rows and columns of wire conductors which comprise the anode and cathode electrodes. By selectively addressing the discharge cells through controlled application of a sufficient potential to individual ones of the orthogonal conductors, plasma discharges are generated in the discharge cells at the intersection points to produce a visible image having a predetermined two-dimensional shape.

SUMMARY OF THE INVENTION

The present invention comprises a field controlled, hollow cathode plasma discharge element including a cathode electrode and an anode electrode sealed within an envelope filled with an ionizable mixture of gases. Aligned openings are provided in the cathode and anode electrodes forming hollow electrodes. The plasma discharge element further includes a field control electrode positioned within the sealed envelope adjacent to either the anode or cathode electrode. The three electrodes are spaced apart from each other to define a discharge cell through which a discharge electric field is generated, and within which a discharge electric field instigated plasma discharge occurs. The field control electrode generates a control electric field for distorting the shape of the discharge electric field and affecting the intensity of the plasma discharge. Varying the strength of the control electric field effectuates proportionate changes in the intensity of the plasma discharge current.

The present invention further comprises a multi-element, field controlled, hollow cathode plasma discharge panel wherein a plurality of the field controlled plasma discharge elements are arrayed in a matrix configuration and selectively addressed through individual field control electrodes to individually instigate and control the intensity of individual plasma discharges. Through sequential addressing, a visible image having a predetermined two-dimensional shape may be generated and displayed by the panel.

The present invention still further comprises an active control circuit for actuating the field control electrode. The active control circuit comprises a pair of field effect transistors interconnected to form a "set and leave" circuit. The components of the circuit are advantageously fabricated at the back of the multi-element field controlled plasma discharge panel thus obviating the need to use transparent semiconductor devices and thin film fabrication techniques. Alternatively, the active control circuit for actuating the field control electrode comprises a surface field effect device fabricated from layered insulators and conductors instead of semiconductor materials. In multi-element devices, switching circuitry is used to address the active control circuits and thus control actuation of individual ones of the elements in the matrix. The electrical connection between the switching circuitry and the control circuits is made using orthogonal sets of control lines intersecting at each discharge element.

The present invention yet further comprises a method for using an external electric field to control the intensity of a field instigated plasma discharge. In accordance with the method of the present invention, a first electric field is generated in an environment of an ionizable gas with the first electric field having a sufficient intensity to instigate a plasma discharge. Next, a second electric field is generated in the vicinity of, and in interaction with the first electric field. Finally, the strength of the generated second electric field is varied to alter the shape of the proximately located first electric field, with the alterations in the shape of the first electric field proportionately affecting the intensity of the plasma discharge.

The present invention still further comprises a specific geometry for improving discharge device optical efficiency. The geometry includes a lens-shaped phosphor coating positioned adjacent the discharge cell. Contouring of the phosphor coating into a lens-shape improves the directivity of visible light emissions and the efficiency of conversion of emitted ultraviolet photons in the plasma discharge to visible light. The geometry further includes a concave surface geometry for at least the discharge electric field generation electrode adjacent the light producing phosphor coating. Contouring and polishing of this electrode improves the overall optical efficiency of the discharge device by reflecting light generated by either the plasma discharge itself or the phosphor coating. In order to reduce reflectance away from the discharge element and increase device contrast, the remaining surface of the electrode is coated to absorb light.

The present invention still further comprises a method and apparatus for manufacturing single element field controlled plasma discharge devices and multi-element field controlled plasma discharge devices. The method of present invention laminates a plurality of layers of conductors and insulators forming the discharge field generation electrodes and field control electrode, as well as the control lines and control circuits. Laser devices are used to make holes in the electrodes and insulators and to fabricate the control circuits. Testing and repair of the laminations is then performed. The laminations are then sealed within a glass envelope that is filled with a gas mixture.

The present invention further comprises the use of the field controlled, hollow cathode plasma discharge devices of the present invention in either their single element or multi-element matrix form as amplifiers, switches or optical sources (displays).

BRIEF DESCRIPTION OF THE DRAWINGS

A more complete understanding of the method and apparatus of the present invention may be had by reference to the following Detailed Description when taken in conjunction with the accompanying Drawings wherein.

DETAILED DESCRIPTION OF EMBODIMENTS

Figure 1:
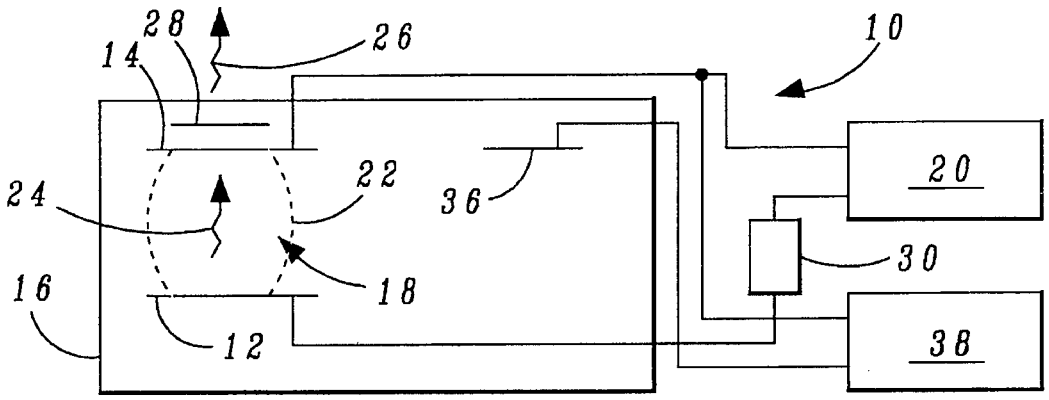
FIGURE 1 (PRIOR ART)
FIG. 1 is schematic diagram of a prior art plasma discharge display element.

Reference is now made to FIG. 1 wherein there is shown a schematic diagram of a prior art plasma discharge display element 10 including a cathode electrode 12 spaced apart from an anode electrode 14. The electrodes 12 and 14 are positioned within a glass envelope 16 that is sealed and filled with an ionizable inert gas. The area between the electrodes 12 and 14 comprises a discharge cell 18 wherein a plasma discharge is generated.

A voltage source 20 outputting a time dependent voltage (AC or DC) is connected to the electrodes 12 and 14 of the display element 10. Application of a voltage potential across the electrodes 12 and 14 generates an electric field (schematically illustrated by broken lines 22) in the discharge cell 18. When a sufficient potential is applied between the cathode electrode 12 and the anode electrode 14, a field instigated avalanche breakdown of the insulating properties of the gas atoms occurs and a current flows between the electrodes forming a plasma discharge. The plasma discharge contains energetic electrons, excited atoms and ions.

The collision of the energetic electrons in the plasma discharge with the ionizable gas atoms maintained in the discharge cell 18 excites the gas atoms into emission of a wide spectrum of radiation in the form of photons of light 24. The characteristics of the ionizable inert gas or mixture of gases that are sealed within the envelope 16 dictate the dominant wavelength of the photons of light 24 radiated from within the discharge cell 18. For example, neon gas atoms emit radiation in the visible red-orange spectrum when excited by a plasma discharge. Xenon gas atoms, on the other hand, emit radiation in the invisible ultraviolet spectrum. This invisible radiation is converted to visible photons of light 26 by phosphors 28 coated on the inside of the glass envelope 16.

Plasma discharges typically produce a negative differential resistance across the electrodes 12 and 14. To prevent the plasma discharge from transitioning to an arc that may destroy or damage the electrodes 12 and 14, the display element 10 and/or the voltage source 20, a current limiting impedance 30 is connected in series between the voltage source and one of the electrodes. When the voltage source 20 outputs alternating polarity voltage, the impedance 30 comprises a capacitor. A direct current output from the voltage source 20, on the other hand, requires the use of a resistor for the current limiting impedance 30.

In order for the radiated photons of light 24 and 26 to be better observed or detected outside the envelope 16, one of the electrodes 12 or 14 can be manufactured of a transparent material, such as tin oxide. The optical transmission efficiency of the materials used for a transparent electrode, however, is unsatisfactory. One solution to this problem, as illustrated in the prior art hollow electrode plasma display element 32 shown in FIG. 2, is to provide an opening 34 in one of the electrodes (in this case, the anode electrode 14) through which the radiated photons of light 24 may escape from the discharge cell 18.

Figure 2:
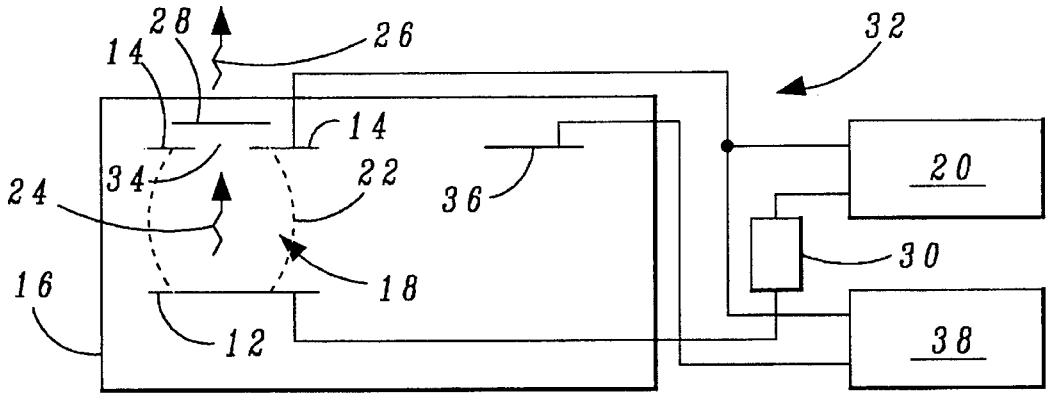
FIGURE 2 (PRIOR ART)
FIG. 2 is a schematic diagram of a prior art hollow electrode plasma discharge display element.

Reference is now made to both FIGS. 1 and 2. In many applications, it is desirable to quickly switch the plasma display element 10 or 32 between its off mode and its on (discharge) mode. However, there is a noticeable delay between application of the potential across the electrodes 12 and 14 and the generation of a plasma discharge within the discharge cell 18. To speed the reaction time of the plasma display elements 10 and 32, an additional, third electrode 36 is provided for generating free charges that seed the avalanche breakdown within the discharge cell 18 leading to a plasma discharge. The third electrode is connected to a voltage source 38.

Figure 3:
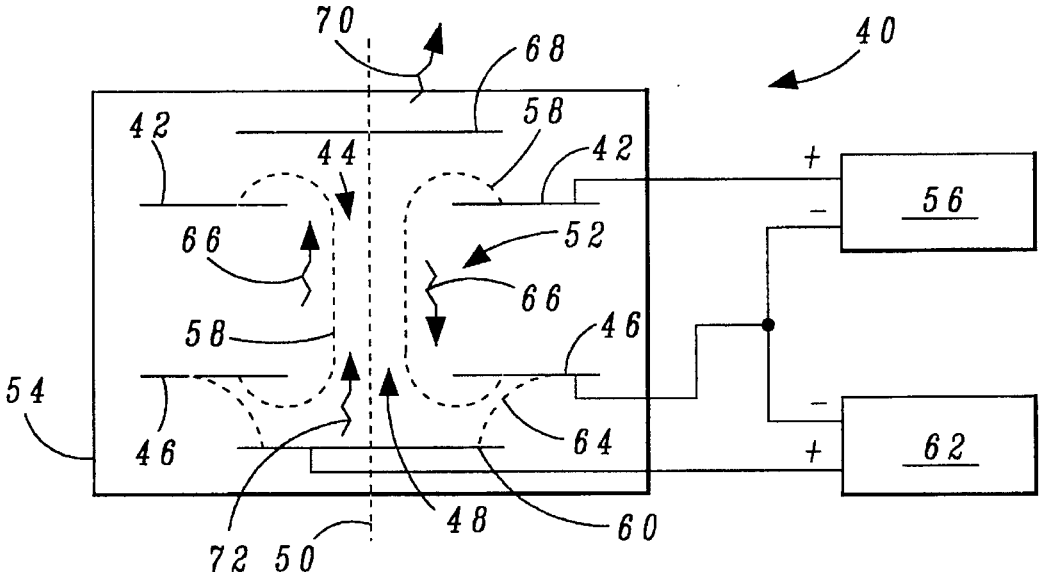
FIG. 3 is a schematic diagram of a field controlled, hollow cathode plasma discharge display element of the present invention.

Reference is now made to FIG. 3 wherein there is shown a schematic diagram of the field controlled, hollow cathode plasma discharge element 40 of the present invention. The field controlled plasma discharge element 40 includes a hollow anode electrode 42 (having an opening 44) spaced apart from a hollow cathode electrode 46 (having an opening 48). The openings 44 and 48 in the pair of electrodes 42 and 46 are substantially aligned with each other along common axis 50. The discharge element 40 further includes a third electrode 60 positioned adjacent to the cathode electrode 46 to form a capacitor. The electrodes 42, 46 and 60 are positioned within an envelope 54 that is sealed and filled with an ionizable inert gas. If the element 40 functions as a display, the envelope 54 is manufactured of a transparent material.

The area between the electrodes 42, 46 and 60 around the common axis 50 comprises a discharge cell 52. A discharge voltage output from a first voltage source 56 is applied between the electrodes 42 and 46 to generate a discharge electric field (schematically represented by broken lines 58) within the discharge cell 52. Current flows between the pair of electrodes 42 and 46 following the field lines of the discharge electric field 58, the longest of which field lines pass through the openings 44 and 48 to terminate on the top side of the anode 42 and the bottom side of the cathode 46. Application of a sufficient discharge voltage potential to the pair of electrodes 42 and 46 instigates a plasma discharge in the discharge cell 52. The intensity of the plasma discharge depends on the amount of current flowing between the pair of electrodes 42 and 46.

The plasma discharge instigated in the hollow cathode, discharge element 40, unlike that with the prior art plasma discharge display of FIG. 1, has a positive differential resistance. The differential resistance of a hollow cathode plasma discharge will remain positive for low currents, and thus a series connected current limiting inductance (see FIG. 1) need not be included between the electrodes and the first voltage source 56. Because the differential resistance remains positive, a plurality of discharge elements 40 may be electrically connected in parallel with each other without danger of current diversions to adjacent discharge elements.

The third electrode 60 is oriented substantially parallel to the pair of electrodes 42 and 46, and is positioned external to the electrodes 42 and 46 in alignment with the openings 44 and 48 along the common axis 50. The placement of the third electrode 60 in the display element 40 forms a capacitor between the third electrode and the cathode electrode 46. It will, of course, be understood that the third electrode 60 could alternatively be positioned adjacent the anode electrode 42 if desired. A control voltage output from a second voltage source 62 is applied between the third electrode 60 and the cathode electrode 46 to generate a control electric field (schematically represented by broken lines 64). The control electric field 64 interacts with and, depending on its strength, distorts the shape of the discharge electric field 58. Such distortions in the shape of the discharge electric field 58 affect the amount of current flowing between the anode electrode 42 and the cathode electrode 46, and thus influence the intensity of the plasma discharge. Varying the control voltage potential applied to the third electrode 60 alters the discharge electric field 58 spatial distribution passing through the openings in the anode and cathode electrodes. Such changes cause corresponding variances in the flow of current between the electrodes 42 and 46 to effectuate proportionate changes in the intensity of the plasma discharge.

The discharge element 40 may be configured as a switch or amplifier (transistor). In the switch configuration, turning the voltage applied to the control electrode 60 on and off will act to switch the device 40 on and off by starting and stopping the flow of current between the anode and cathode electrodes. In the amplifier configuration, adjusting the strength of the voltage applied to the control electrode (base) causes proportionate changes in the amount of current flowing between the anode and cathode electrodes (emitter and collector). Experimentation has shown that voltages in the range of as low as thirty volts applied to the control electrode 60 effectuate substantially linear control over current versus voltage in a four-hundred volt output voltage across the anode and cathode electrodes 42 and 46. With decreased spacing between the control electrode 60 and the cathode electrode 46, control voltages less than thirty volts may be used.

The collision of energetic electrons in the plasma discharge with the gas mixture maintained in the discharge cell 52 excites the ionizable gas atoms into emission of a wide spectrum of radiation in the form of photons of light 66. The hollow cathode geometry with openings 44 and 48 in both of the electrodes 42 and 46 disperses the area in which such electron and ion interaction with the electrodes occurs, and thus reduces erosion to facilitate a longer operating lifetime for the discharge element 40.

In a display application, a coating of phosphor 68 is provided on the glass envelope 54 to absorb the invisible photons 66 of ultraviolet radiation and emit visible photons of light 70. The third electrode 60 may also be coated with phosphor 72 to absorb rearwardly directed ultraviolet photons 66 and emit visible photons 70 thus increasing the overall optical efficiency of the discharge element 40 of the present invention. The brightness of the visible light emitted by the discharge element 40 is directly proportional to the intensity of the plasma discharge current, and thus the brightness of the light is controlled by varying the control voltage potential output by the second voltage source 62.

Figure 4:
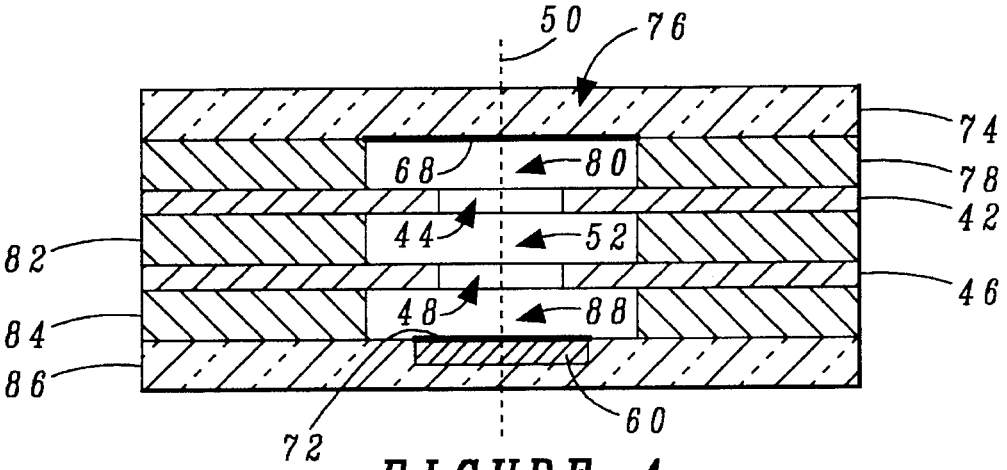
FIG. 4 is a cross-sectional view of the display element of FIG. 3.

Reference is now made to FIG. 4 wherein there is shown a cross-sectional view of the hollow cathode discharge element 40 of the present invention schematically illustrated in FIG. 3. The glass envelope 54 comprises a transparent front plate 74 forming a viewing window 76 for the discharge element 40 through which any visible light generated by a plasma discharge may be observed. Phosphor 68 for converting plasma discharge generated ultraviolet photons to visible light is coated to a back surface of the front plate 74 in the area of the viewing window 76. A spacer 78 of suitable dielectric or other insulating material is positioned between the front plate 74 and the anode electrode 42. An opening 80 is provided in the spacer 78 substantially aligned with the opening 44 in the anode electrode 42 along common axis 50. The opening 80 in the spacer 78, however, has a larger diameter than the opening 44 in the anode electrode 42. A spacer 82 of suitable dielectric or other insulating material is positioned between the anode electrode 42 and the cathode electrode 46 to maintain a separation between the electrodes approximately equal to the diameter of the openings 44 and 48. An opening, substantially aligned along common axis 50 and having a diameter larger than the openings 44 and 48 in the electrodes 42 and 46, is provided in the spacer 82. A spacer 84 of suitable dielectric or other insulating material is positioned between the cathode electrode 46 and a back plate 86 of the glass envelope 54. An opening 88, substantially aligned along common axis 50 and having a diameter larger than the openings 44 and 48 in the electrodes 42 and 46, is provided in the spacer 84. The third electrode 60 is positioned on a front surface of the back plate 86 substantially aligned with the openings 44 and 48 in the electrodes 42 and 46 and positioned at a location opposite the viewing window 76 along common axis 50. Phosphor 72 for converting rearwardly directed plasma discharge generated ultraviolet photons to visible light may be coated to a front surface of the third electrode 60.

Figure 5:
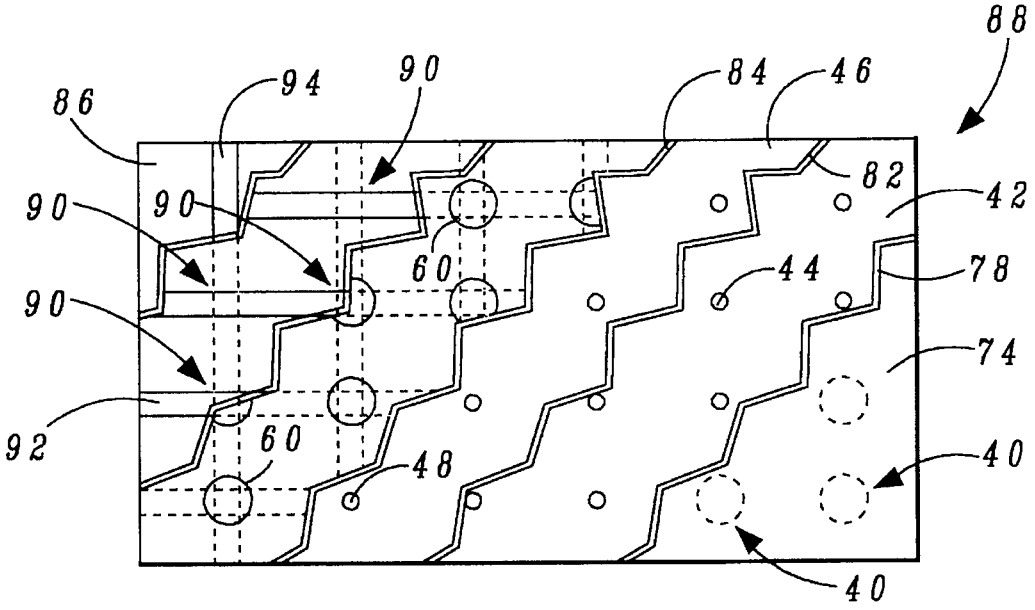
FIG. 5 is partially broken away top view of a multi-element field controlled flat panel display of the present invention.

Reference is now made to FIG. 5 wherein there is shown a partially broken away top view of a multi-element field controlled panel discharge device 88 of the present invention. The discharge device 88 comprises a plurality of discharge elements 40 (FIGS. 3 and 4) arrayed in a row by column matrix configuration. Individual elements 40 in the device 88 are located at the points of intersection 90 between individual ones of a set of "x" control lines 92 and individual ones of a set of "y" control lines 94. Actuation of the elements 40 in the device 88 is effectuated by selectively addressing the x control lines 92 and the y control lines 94. Only at that one element 40 positioned at the point of intersection 90 between two addressed control lines 92 and 94 will a plasma discharge (producing a light emission) be instigated by changing the control electrode voltage. To generate a two dimensional visual image with the device 88, the control lines 92 and 94 are sequentially and repeatedly addressed in proper order to generate light emissions at the proper locations on the device 88.

The set of y control lines 94 are provided in a common plane and positioned above (i.e., on top of) the back plate 86.

The set of x control lines 92 are also provided in a common plane and are positioned spaced apart from and above the y control lines 94. The plurality of third electrodes 60 comprise conducting disks that are also provided in a common plane positioned spaced apart from and above the x control lines 92. The x and y control lines 92 and 94 are connected or coupled to the third electrodes 60 by means of a control circuit (not shown, see FIGS. 6 and 7).

The cathode electrode 46 comprises a conducting plane including the plurality of openings 48 arrayed in the matrix configuration. The cathode electrode 46 conducting plane is positioned above the third electrodes 60 and separated therefrom by means of the spacer 84. The anode electrode 42 is similarly formed of a conducting plane including the plurality of openings 44 arrayed in the matrix configuration corresponding in location to the openings 48 in the cathode electrode 46. The anode electrode 42 conducting plane is positioned above the cathode electrode 46 conducting plane and separated therefrom by means of the spacer 82. The front plate 74 is positioned above and separated from the anode electrode 42 conducting plane by the spacer 78.

It will, of course, be understood that the panel device 88 may be fabricated to have either a flat or curved surface and to produce either color or black and white images. Flat panel displays are especially useful in applications such as television screens and monitors. Curved panel displays are especially useful in video simulators and virtual reality devices.

The multi-element field controlled panel discharge device 88 may also be advantageously utilized as a high voltage, high current switch replacing a thyratron. The use of a single element 40 as a relatively low current handling switch has been described above. In a multi-element device 88, the plurality of elements 40 are electrically connected to each other in parallel. Any voltage applied thereto is distributed evenly across the plurality of elements 40 thus enabling the device 88 to handle application of high currents. The application of a voltage to the individual control electrodes 60 is used to control actuation of the plurality of elements 40 in the device 88 and thus effectuate control over switching. Furthermore, with the capability to individually control the actuation of the elements 40, only a few of the many available elements need be actuated at any one time to handle the current flow. Thus, the switching discharges may be cycled around the device 88 to permit individual elements 40 to cool before being selected for a subsequent switching discharge.

Figure 6:
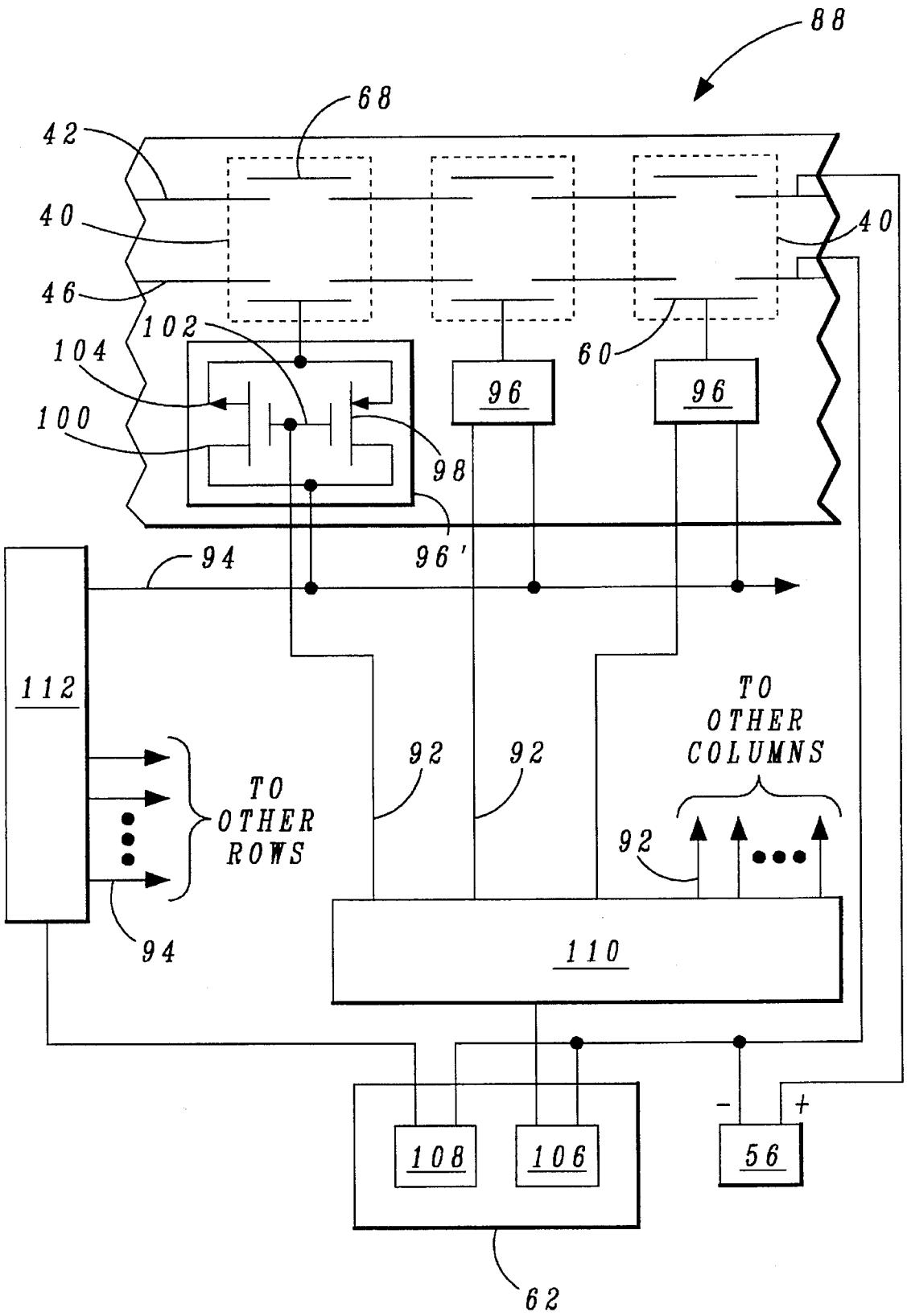
FIG. 6 is a schematic diagram of the multi-element field controlled flat panel display shown in FIG. 5 using an active FET circuit for controlling actuation of each discharge device.

Reference is now made to FIG. 6 wherein there is shown a schematic diagram of the multi-element field controlled panel discharge device 88 of the present invention. For simplification of this drawing, only three elements 40 in a single row of the device 88 are illustrated.

The x and y control lines 92 and 94 are connected to the third electrodes 60 by means of a bi-directional control circuit 96 for controlling the flow of current into and out of the capacitance formed between the control electrode 60 and the cathode electrode 46. Each of the control circuits 96 in a given column of the device 88 are connected to a single one of the x control lines 92 corresponding to that column. Similarly, each of the control circuits 96 in a given row of the device 88 are connected to a single one of the y control lines 94 corresponding to that row.

In one embodiment, the control circuit 96 comprises a "set and leave" circuit 96' including a pair of interconnected field effect transistors (FETs) 98 that are used to control the voltage on the field control electrode 60. Each FET 98 includes a drain terminal 100, a gate terminal 102 and a source terminal 104. In each control circuit 96', the drain terminals 100 of the pair of included FETs 98 are connected to each other and to the y control line 94 for the row in which the display element 40 is located. The gate terminals 102 of the pair of included FETs 98 are connected to each other and to the x control line 92 for the column in which the display element 40 is located. The source terminals 104 of the pair of included FETs 98 are also connected to each other, and are further connected to the third electrode 60 of the display element 40.

In the panel device 88, the second voltage source 62 comprises a gate voltage supply 106 and a drain voltage supply 108. The gate voltage supply 106 is selectively connected to each of the control circuits 96' (via the connected FET 98 gate terminals 100) through a column switching circuit 110 and the x control lines 92. The drain voltage supply 108, on the other hand, is selectively connected to each of the control circuits 96' (via the connected FET 98 drain terminals 102) through a row switching circuit 112 and the y control lines 94. The switching circuits 110 and 112 operate to select a discharge element 40 in the device 88 for activation by addressing an x and y control line 92 and 94 for application of the voltages output from the gate voltage supply 106 and the drain voltage supply 108, respectively. Application of voltages of the same polarity to the control circuit 96' actuates the discharge element 40 located at the intersection point 90 between the selected control lines 92 and 94 changes the field control electrode 60 voltage and instigates a plasma discharge. The intensity of the discharge (and accordingly the brightness of the emitted visible light) is controlled by varying the relative voltages output from the supplies 106 and 108.

The control circuit 96' is advantageously placed at the rear of the device 88. Placement at this location facilitates manufacture of the device 88 as the control circuit 96' and its associated control lines 92 and 94 can be separately manufactured as one unit, tested, and only thereafter mounted to the remainder of the device components. The placement at the rear of the device 88 further obviates the need to use expensive thin film fabrication techniques historically needed for fabricating the transparent control circuits placed in front of other display devices like liquid crystal displays. Furthermore, with rear placement, redundant electronic components (like FETs) can be fabricated and later activated through known laser selection techniques in the event the primary components subsequently fail or are initially defective.

Figure 7:
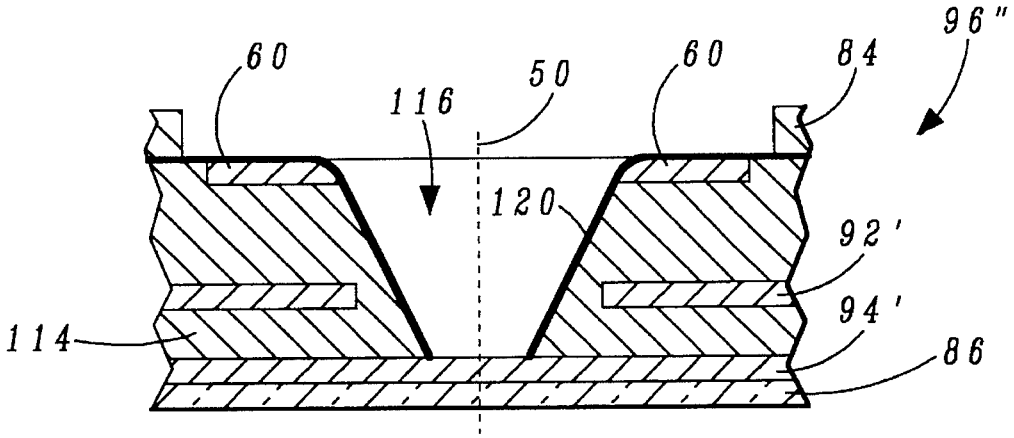
FIG. 7 is a cross-sectional view of an active surface field effect device for controlling actuation of each discharge device.

Reference is now made to FIG. 7 wherein there is shown a cross-sectional view of an alternative embodiment 96" of the bi-directional control circuit 96 illustrated in FIG. 6. The control circuit 96" comprises an active surface field effect device that does not utilize semiconductor devices (like the FETs 98) for controlling actuation of the discharge element 40. Instead, the control circuit 96" comprises layers of insulators and conductors that are more easily and reliably fabricated than semiconductor devices.

The control circuit 96" includes a voltage source electrode 94' comprising the y control line, and a gate electrode 92' comprising the x control line. The voltage source electrode 94' is positioned above (i.e., on top of) the back plate 86. The gate electrode 92' is positioned above and is spaced apart from the voltage source electrode 94' by an insulating spacer 114 which also separates the gate electrode 92' from the third electrode 60 of the discharge element 40. Openings are formed in the third electrode 60, gate electrode 92' and spacer 114 to define a conically-shaped aperture 116. The aperture 116 as well as the front surface 118 of the third electrode 60 is coated with an insulating layer 120 comprising, for example, magnesium oxide. The insulating layer 120 functions to reduce secondary electron emission. Although exposed by the aperture 116, the surface of the voltage source electrode 94' need not be coated with the insulating layer 120.

The photons of light and ions generated in the discharge cell 52 of discharge element 40 produce a layer of surface charge on the insulator layer 120. Altering the potentials applied to the third electrode 60, voltage source electrode 94', and the gate electrode 92' controls the movement of the layer of surface charge. Thus, the control circuit 96" comprises a field effect device similar in operation to a field effect transistor.

Figure 8:
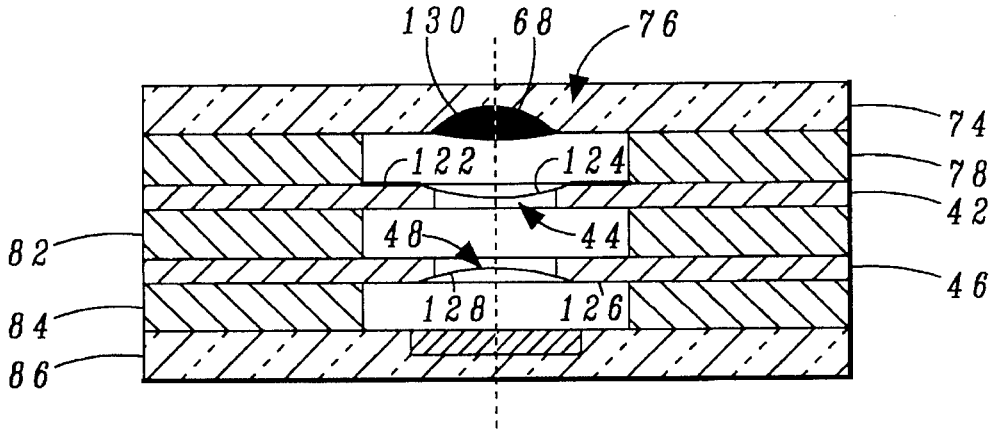
FIG. 8 is a cross-sectional view of the plasma discharge device illustrating geometry variations for the field generation electrodes and phosphor coating.

Referring now to FIG. 8, there is shown in cross-section an alternative geometry for the electrodes 42 and 46 and the phosphor coating 68 of the plasma discharge device 40. A front surface 122 of the anode electrode 42 at the opening 44 is contoured to define a concave surface 124. Preferably the concave surface 124 is polished to reflect rearwardly directed photons of light out through the viewing window 76. A rear surface 126 of the cathode electrode 46 is similarly contoured and polished to define a concave, light reflecting surface 128. In order to increase the contrast of the discharge element 40 for use as a display, the remainder of the front surface 122 of the anode electrode 42 outside of the concave surface 124 is coated in a black or otherwise spectrally absorptive color. A concave surface 130 is further formed in the front plate 74 at the viewing window 76. The phosphor coating 68 for converting ultraviolet to visible light is lens-shaped and contoured to conform to the concave surface 130. The lens shape of the phosphor 68 and concave surface 130 at the viewing window 76 improve directivity of the produced visible light as well as enhance the efficiency of the ultraviolet-to-visible light conversion.

Figure 9:
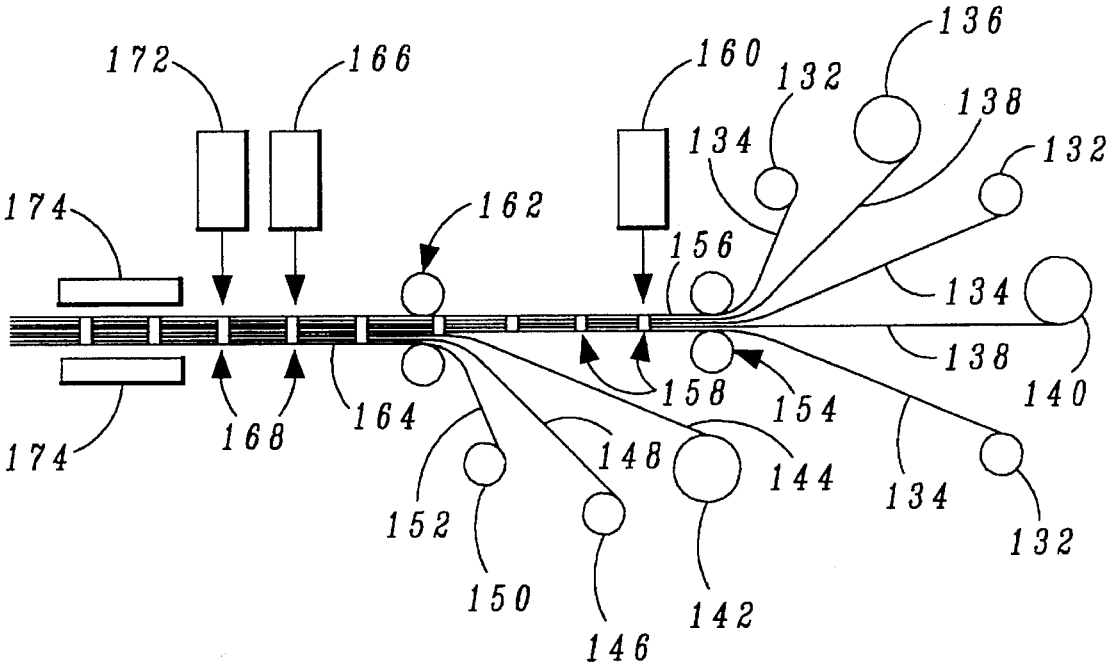
FIG. 9 is a side view illustrating one method for manufacturing the plasma discharge devices of the present invention.

Reference is now made to FIG. 9 wherein there is shown a side view illustrating one method and apparatus for laminated manufacturing of the plasma discharge devices 40 of the present invention. The apparatus includes a plurality of rolls of conducting and insulating sheet materials comprising: rolls 132 of insulating sheet material 134 for forming the various included spacers; a roll 136 of conducting sheet material 138 for forming the anode electrode 42; a roll 140 of conducting sheet material 138 for forming the cathode electrode 46; a roll 142 of insulating sheet material 144 including a plurality of individual control electrodes 60 positioned thereon; a roll 146 of insulating sheet material 148 including a plurality of x control lines 92 positioned thereon; and, a roll 150 of insulating sheet material 152 with a plurality of y control lines 94 positioned thereon.

The various insulating and conducting sheet materials are oriented with respect to each other from top to bottom in the following order: insulating sheet material 134, conducting sheet material 138 (anode), insulating sheet material 134, conducting sheet material 138 (cathode), and insulating sheet material 134. The foregoing materials are fed to and pinched between pinch rollers 154 to form a first lamination 156. A plurality of holes 158 are then formed in the first lamination 156 by means of a laser device 160. The remaining insulating sheet materials are oriented with respect to each other from top to bottom in the following order: insulating sheet material 144 (control electrodes); insulating sheet material 148 (x control lines); and, insulating sheet material 152 (y control lines). The foregoing materials, along with first lamination 156, are fed to and pinched between pinch rollers 162 to form a second lamination 164. A laser or other type of cutting, drilling or etching device 166 then forms the openings 168 in the control electrode and x control lines for the surface field effect device (96" in FIG. 7). An insulating coating of magnesium oxide is then applied 170 in the openings 168. Alternatively, the laser device 166 is used to select and activate semiconductors comprising the control circuit 96' (FIG. 6) connected to the field control electrode 60. Following inspection, testing and repair 172, the second lamination 164 is sealed within a glass envelope 174 that is filled with a mixture of gases to form the multi-element plasma discharge device 88 of the present invention. If individual devices are desired, the second lamination 164 is divided, and the individual elements 40 sealed within individual gas containing glass envelopes.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A plasma discharge element, comprising:

a sealed envelope containing an inert gas;

a pair of hollow field generation electrodes positioned within the sealed envelope, the hollow field generation electrodes generating, in response to the application of a first potential thereto, a plasma discharge inducing discharge electric field; and a control electrode positioned within the sealed envelope external to the field generation electrodes, the control electrode generating, in response to the application of a second potential thereto, a control electric field for distorting the shape of the generated discharge electric field and affecting the intensity of the induced plasma discharge.

2. The plasma discharge element as in claim 1 wherein the pair of hollow field generation electrodes comprise:

an anode electrode having a opening defined therein; and a cathode electrode also having an opening defined therein, the openings in the anode and cathode electrodes being substantially aligned along an axis.

3. The plasma discharge element as in claim 2 wherein at least one of the pair of electrodes includes a concave, polished surface for reflecting light generated by the plasma discharge through the window, the polished surface facing a viewing window in the envelope.

4. The plasma discharge element as in claim 2 wherein the axis passes through the control electrode to position the control electrode in substantial alignment with the openings in the anode and cathode electrodes.

5. The plasma discharge element as in claim 1, further including a phosphor coating on the inside surface of the glass envelope for converting ultraviolet light emitted by the plasma discharge to visible light.

6. The plasma discharge element as in claim 5 wherein the phosphor coating is lens-shaped.

7. The plasma discharge element as in claim 5 further including a phosphor coating on the surface of the control electrode for converting the emitted ultraviolet light to visible light.

8. The plasma discharge element as in claim 5 further including a spectrally absorptive coating on the anode electrode for improving contrast.

9. The plasma discharge element as in claim 1 wherein the discharge element comprises a switch.

10. The plasma discharge element as in claim 1 wherein the discharge element comprises an amplifier.

11. The plasma discharge element as in claim 1 further including means for varying the strength of the second potential, such variances in the second potential affecting discharge electric field distortion and causing proportionate changes in the intensity of the induced plasma discharge.

12. The plasma discharge element as in claim 11 wherein the means for varying comprises a bi-directional control circuit connected to the control electrode.

13. The plasma discharge element as in claim 11 wherein the means for varying comprises a surface field effect device coupled to the control electrode.

14. In a plasma discharge element comprising a pair of electric field generation electrodes and a proximately positioned control electrode, a method for controlling the generation and intensity of a plasma discharge comprising the steps of:

applying a first potential to the pair of field generation electrodes of sufficient strength to generate a plasma discharge inducing electric field;

applying a second potential to the control electrode to generate a control electric field proximate to the plasma discharge inducing electric field; and varying the strength of the second potential to cause distortions in the shape of the generated plasma discharge inducing electric field that effectuate proportionate changes the intensity of the induced plasma discharge.

15. A method for controlling the intensity of a plasma discharge comprising the steps of:

generating a first electric field in an environment of an ionizable gas, said first electric field of sufficient strength to initiate a plasma discharge;

generating a second electric field proximate to the first electric field; and varying the strength of the generated second electric field to cause distortions in the shape of the proximately located first electric field that effectuate proportionate changes in the intensity of the initiated plasma discharge.

16. A gas discharge element, comprising:

means for containing an ionizable gas;

means for generating a first electric field in the means for containing, said first electric field of sufficient strength for initiating a gas discharge;

means for generating a second electric field in the means for containing sufficiently proximate to the first electric field to distort the shape of the first electric field;

means for varying the strength of the generated second electric field to control the shape of the first electric field and cause proportionate changes in the intensity of the gas discharge.

17. The gas discharge element as in claim 16 wherein the means for containing comprises a sealed glass envelope.

18. The gas discharge element as in claim 16 wherein the means for generating the first electric field comprises a pair of spaced apart electrodes.

19. The gas discharge element as in claim 18 wherein the pair of spaced apart electrodes comprise:

a hollow cathode electrode; and a hollow anode electrode.

20. The gas discharge element as in claim 18 wherein the means for generating the second electric field comprises a control electrode positioned adjacent, but external to the pair of spaced apart electrodes.

21. The gas discharge element as in claim 20 wherein each of the pair of spaced apart electrodes includes an opening therein, the openings being substantially aligned with each other along an axis.

22. The gas discharge element as in claim 21 wherein the control electrode is positioned posited substantially aligned with the openings in the pair of spaced apart electrodes along the common axis.

23. The gas discharge element as in claim 21 wherein the opening in the anode electrode is contoured to form a concave shape for reflecting light generated by the plasma discharge.

24. The gas discharge element as in claim 21 wherein the anode electrode is coated with a spectrally absorptive coating for increasing contrast.

25. The gas discharge element as in claim 20 further including means for controlling the application of a variable potential to the control electrode.

26. The gas discharge element as in claim 25 wherein the means for controlling comprises a surface field effect device coupled to the control electrode.

27. The gas discharge element as in claim 25 wherein the means for controlling comprises a bi-directional semiconductor circuit connected to the control electrode.

28. The gas discharge element as in claim 27 wherein the semiconductor circuit comprises:

first and second field effect transistors each having a drain, a gate and a source;

means for connecting the drains of the first and second field effect transistors together and to a drain voltage source;

means for connecting the gates of the first and second field effect transistors together and to a gate voltage source; and means for connecting the sources of the first and second field effect transistors together and to the third electrode.

29. The gas discharge element as in claim 16 further comprising a phosphor coating on the glass envelope for converting ultraviolet light generated in the plasma discharge to visible light.

30. The gas discharge element as in claim 29 wherein the phosphor coating is lens-shaped.

31. The gas discharge element as in claim 16 wherein the discharge element comprises a switch.

32. The gas discharge element as in claim 16 wherein the discharge element comprises an amplifier.

33. A panel plasma discharge device, comprising:

a plurality of plasma discharge cells arrayed in a column by row matrix configuration;

a pair of hollow electrodes for each discharge cell, the pair of hollow electrodes generating, in response to the application of a first potential, a first electric field in a gas atmosphere;

a plurality of control electrodes, one for each discharge cell, each control electrode generating, in response to the application of a second potential, a second electric field proximate to the first electric field;

means for selectively instigating plasma discharges at selected discharge cells; and means for varying the strength of the second electric field to distort the shape of the first electric field and effectuate proportionate changes in the intensity of the instigated plasma discharge.

34. The panel discharge device as in claim 33 wherein the means for selectively instigating comprises a switching circuit for selectively actuating discharge cells to instigate a plasma discharge.

35. The panel discharge device as in claim 34 wherein the switching circuit comprises:

a plurality of column control lines, each column control line connected to each of the discharge cells in that column;

a plurality of row control lines, each row control line connected to each of the discharge cells in that row; and means connected to the plurality of column and row lines for selectively addressing the column and row lines to control actuation of the discharge cell.

36. The panel discharge device as in claim 33 further including a phosphor deposit at each discharge cell for converting ultraviolet photons generated in the plasma discharge to visible light.

37. The panel discharge device as in claim 36 wherein the phosphor deposit is lens-shaped.

38. The panel discharge device as in claim 33 further including a spectrally absorptive coating surrounding each discharge cell and applied to the surface of the electrode for increasing viewing contrast.

39. The panel discharge device as in claim 33 wherein the surface of at least one of the electrodes is contoured to form a concave surface for reflecting light generated by the plasma discharge.

40. The panel discharge device as in claim 33 wherein the means for varying comprises means for altering the second potential applied to the selected discharge cells to control plasma discharge intensity at the selected cells.

41. The panel discharge device as in claim 40 wherein the means for altering comprises a bi-directional semiconductor circuit connected to each of the plurality of control electrodes.

42. The panel discharge device as in claim 40 wherein the means for altering comprises a surface field effect device coupled to each of the plurality of control electrodes.

43. A plasma discharge element comprising from a front to a back thereof:

a viewing window;

a first electrode adjacent the viewing window having an opening therein substantially aligned with the viewing window along an axis;

a second electrode spaced apart from the first electrode and having an opening therein substantially aligned along the axis, the first and second electrodes generating, in response to the application of a first potential thereto, a discharge electric field for ionizing a gas maintained between the first and second electrodes and instigating a plasma discharge; and a third electrode spaced apart from the second electrode and aligned along the axis, the third electrode generating, in response to the application of a second potential thereto, a control electric field for distorting the shape of the discharge electric field and controlling the intensity of the instigated plasma discharge in proportion to the applied second potential.

44. The plasma discharge element as in claim 43 further including a phosphor coating between the display window and the first electrode for converting ultraviolet radiation emitted by the plasma discharge into visible light.

45. The plasma discharge element as in claim 44 wherein the phosphor coating is lens-shaped.

46. The plasma discharge element as in claim 44 wherein the third electrode is positioned along the axis opposite the viewing window, further including a phosphor coating applied to the third electrode for converting ultraviolet radiation emitted by the plasma discharge into visible light.

47. The plasma discharge element as in claim 44 wherein the surface of the first electrode facing the viewing window is coated with a spectrally absorptive coating for increasing viewing contrast.

48. The plasma discharge element as in claim 44 wherein the surface of the first electrode at the opening therein is contoured to form a concave surface for reflecting light generated by the plasma discharge.

49. The plasma discharge element as in claim 44 further comprising means mounted to the back of the element for controlling the application of the second potential to the third electrode.

50. The plasma discharge element as in claim 49 wherein the means for controlling comprises a "set and leave" circuit connected to the third electrode.

51. The plasma discharge element as in claim 49 wherein the means for controlling comprises a surface field effect device coupled to the third electrode.

52. The plasma discharge element as in claim 51 wherein the surface field effect device comprises from front to back:

a gate conductor having an opening therein substantially aligned with an opening in the third electrode; and a voltage source conductor;

and further including insulating layers separating the gate conductor from the third electrode and the voltage source conductor from the gate conductor, the insulating layers having a conically-shaped aperture formed therein substantially aligned with the openings in the third electrode and gate conductor.

53. The plasma discharge element as in claim 52 further including an insulating layer on the conically-shaped aperture.

* * * * *

UNITED STATES PATENT AND TRADEMARK OFFICE

CERTIFICATE OF CORRECTION

PATENT NO. : 5,561,348

DATED : Oct. 1, 1996

INVENTOR(S) : Schoenbach et al.

It is certified that error appears in the above-indentified patent and that said Letters Patent is hereby corrected as shown below:

Column 12, line 6 Delete "posited"

Signed and Sealed this

Seventeenth Day of June, 1997

Bruce Lehman

*Attest:*

BRUCE LEHMAN

*Attesting Officer*

*Commissioner of Patents and Trademarks*